US005336659A

United States Patent [19]

Bauer et al.

[11] Patent Number: 5,336,659

[45] Date of Patent: Aug. 9, 1994

[54] ANTISTATIC SUBBING LAYER FOR SLIPPING LAYER IN DYE-DONOR ELEMENT USED IN THERMAL DYE TRANSFER

[75] Inventors: Charles L. Bauer, Webster, N.Y.; Noel R. Vanier, Fort Collins, Colo.

[73] Assignee: Eastman Kodak Company, Rochester, N.Y.

[21] Appl. No.: 125,451

[22] Filed: Sep. 22, 1993

[51] Int. Cl.[5] ..... B41M 5/035; B41M 5/38

[52] U.S. Cl. ..... 503/227; 428/195; 428/488.4; 428/500; 428/913; 428/914

[58] Field of Search ..... 8/471; 428/195, 500, 428/913, 914, 488.4; 503/227

[56] References Cited

U.S. PATENT DOCUMENTS 4,753,921 6/1988 Henzel ..... 503/227

5,106,694 4/1992 Mizobuchi et al. ..... 428/447

OTHER PUBLICATIONS

Research Disclosure Article 33483, Feb. 1992, pp. 155–159.

*Primary Examiner*—B. Hamilton Hess

*Attorney, Agent, or Firm*—Harold E. Cole

[57] ABSTRACT

A dye-donor element for thermal dye transfer comprising a support having on one side thereof a dye layer and on the other side thereof, in order, a subbing layer and a slipping layer, and wherein the subbing layer has antistatic properties and comprises a mixture of 1) a polymer having a molecular weight of at least about 100,000 and containing at least 25 wt. % of a repeating unit containing an alkylene oxide segment, and 2) a copolymer having the formula:

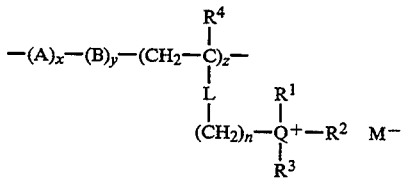

wherein:

A represents units of an addition polymerizable monomer containing at least two ethylenically unsaturated groups;

B represents units of a copolymerizable $\alpha,\beta$-ethylenically unsaturated monomer;

L is a carboxylic group or an aromatic ring;

Q is N or P;

$R^1$, $R^2$ and $R^3$ each independently represents an alkyl or cycloalkyl group having from about 1 to about 20 carbon atoms, or an a ryl or aralkyl group having from about 6 to about 10 carbon atoms;

$R^4$ is H or $Ch_3$;

M is an anion;

n is an integer of from 1 to 6;

x is from about 0 to about 20 mole %;

y is from about 0 to about 90 mole %; and z is from about 10 to about 100 mole %;

said copolymer 2) being present in said mixture in an amount from about 30 to about 75 wt. %.

12 Claims, No Drawings

ANTISTATIC SUBBING LAYER FOR SLIPPING LAYER IN DYE-DONOR ELEMENT USED IN THERMAL DYE TRANSFER

This invention relates to dye donor elements used in thermal dye transfer, and more particularly to the use of a certain subbing layer for a slipping layer on the back side thereof, the subbing layer having antistatic properties.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

A slipping layer is usually provided on the backside of the dye-donor element to prevent sticking to the thermal head during printing. A subbing layer is also usually needed to promote adhesion between the support and the slipping layer.

U.S. Pat. No. 4,753,921 discloses the use of a titanium alkoxide as a subbing layer between a polyester support and a slipping layer. While this material is a good subbing layer for adhesion, problems have arisen with hydrolyric instability, and the layer is difficult to coat in a reproducible manner. It has also been observed that the titanium alkoxide may migrate to the slipping layer surface causing sticking to the thermal head.

For media transport and handling, an antistatic layer is usually needed in a dye-donor element, since there is dust accumulation on a statically charged Surface and potential sparking which may destroy heating elements in the thermal head. The antistatic material is usually located in or over the slipping layer of the dye-donor element.

U.S. Pat. No. 5,106,694 and Research Disclosure article 33483, February 1992, pages 155–159 disclose the use of various antistatic agents, such as quaternary ammonium salts or polymers, which may be mixed with a hydrophilic colloid binder, and used in thermal dye transfer elements. However, there is no disclosure in these references of the use of these materials in a subbing layer for a slipping layer.

It is an object of this invention to provide a subbing layer for a slipping layer which has good adhesion. It is another object of this invention to provide a subbing layer for a slipping layer which has good hydrolytic stability. It is still another object of this invention to provide a subbing layer for a slipping layer which has antistatic properties, thus not requiring the dye-donor element to have a separate antistatic layer.

These and other objects are achieved in accordance with this invention which relates to a dye-donor element for thermal dye transfer comprising a support having on one side thereof a dye layer and on the other side thereof, in order, a subbing layer and a slipping layer, and wherein the subbing layer has antistatic properties and comprises a mixture of 1) a polymer having a molecular weight of at least about 100,000 and containing at least 25 wt. % of a repeating unit containing an alkylene oxide segment, and 2) a copolymer having the formula:

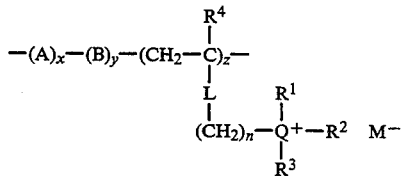

wherein:

A represents units of an addition polymerizable monomer containing at least two ethylenically unsaturated groups;

B represents units of a copolymerizable $\alpha,\beta$-ethylenicatly unsaturated monomer;

L is a carboxylic group or an aromatic ring, such as

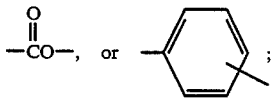

Q is N or P;

$R^1$, $R^2$ and $R^3$ each independently represents an alkyl or cycloalkyl group having from about 1 to about 20 carbon atoms, such as methyl, ethyl or cyclohexyl; or an aryl or aralkyl group having from about 6 to about 10 carbon atoms, such as phenyl or methylphenyl;

$R^4$ is H or $CH_3$;

M is an anion;

n is an integer of from 1 to 6;

x is from about 0 to about 20 mole %;

y is from about 0 to about 90 mole %; and z is from about 10 to about 100 mole %;

the copolymer 2) being present in the mixture in an amount from about 30 to about 75 wt. %.

Examples of polymers containing at least 25 wt. % of a repeating unit containing an alkylene oxide segment for use in the mixture above include the following (provided they have a molecular weight of at least about 100,000) poly(ethylene oxide) (PEO); copolymers incorporating poly (propylene glycol ) monomethacrylate, such as poly(butyl acrylate-copropylene glycol monomethacrylate-co-methyl 2-acrylamido-2-methoxyacetate); poly(propylene glycol); copolymers incorporating polyether segments, such as a polyether/polycarbonate copolymer, e.g., a copolymer of n-butyl acrylate, poly (propylene glycol ) monomethacrylate, and methyl 2-acrylamido-2-methoxyacetate; etc.

Examples of polymers having the above formula for use in the mixture above include poly(N-vinylbenzyl-N,N,N-trimethylammonium chloride-co-ethylene glycol dimethacrylate) (93:7 mole percent) (C-1); poly[2-(N,N,N-trimethylammonium) ethyl methacrylate methosulfate]; poly[2-(N,N,N-trimethylammonium) ethyl acrylate methosulfate]; poly[2- (N,N-diethylamino)ethyl methacrylate hydrogen chloride-co-ethylene glycol dimethacrylate](93:7 mole percent); etc.

In the above formula, A represents units of an addition polymerizable monomer containing at least two ethylenically unsaturated groups such as divinylbenzene, allyl acrylate, allyl methacrylate, N-allylmethacrylamide, 4,4'-isopropylidenediphenylene diacrylate, 1,3-butylene diacrylate, 1,3-butylene dimethacrylate, 1,4-cyclohexylenedimethylene dimethacrylate, diethylene glycol dimethacrylate, diisopropylidene glycol dimethacrylate, divinyloxymethane, ethylene diacrylate, ethylene dimethacrylate, ethylidene diacrylate, ethylidene dimethacrylate, 1,6-diacrylamidohexane, 1,6-hexamethylene diacrylate, 1,6-hexamethylene dimethacrylate, N,N'-methylenebisacrylamide, 2,2-dimethyl -1,3-trimethylene dimethacrylate, phenylethylene dimethacrylate, tetraethylene glycol dimethacrylate, tetramethylene diacrylate, tetramethylene dimethacrylate, 2,2,2-trichloroethylidene dimethacrylate, triethylene glycol diacrylate, triethylene glycol dimethacrylate, ethylidyne trimethacrylate, propylidyne triacrylate, vinyl allyloxyacetate, vinyl methacrylate, 1-vinyloxy-2-allyloxyethane and the like.

In the above formula, B represents units of a copolymerizable $\alpha,\beta$-ethylenically unsaturated monomer such as ethylene, propylene, 1-butene, isobutene, 2-methylpentene, 2-methylbutene, 1,1,4,4-tetramethylbutadiene, styrene and $\alpha$-methylstyrene; monoethylenically unsaturated esters of aliphatic acids such as vinyl acetate, isopropenyl acetate, allyl acetate, etc.; esters of ethylenically unsaturated mono- or dicarboxylic acids such as methyl methacrylate, ethyl acrylate, diethyl methylenemalonate, etc.; and monoethylenically unsaturated compounds such as acrylonitrile, allyl cyanide, and dienes such as butadiene and isoprene.

In the above formula, $M^-$ is an anion such as bromide, chloride, sulfate, alkyl sulfate, p-toluenesulfonate, phosphate, dialkylphosphate or similar anionic moiety.

The subbing/antistat layer of the invention may be present in any concentration which is effective for the intended purpose. In general, good results have been attained using a laydown of from about 0.1 g/m$^2$ to about 0.2 g/m$^2$.

As noted above, the copolymer 2) is present in the mixture in an amount from about 30 to about 75 wt. %. A preferred range is from about 35 to about 50 wt. %.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikaron Violet RS ® (Sumitomo Chemical Co., Ltd.), Dianix Fast Violet 3R FS ® (Mitsubishi Chemical Industries, Ltd.), and Kayalon Polyol Brilliant Blue N BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumikaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumiacryl Blue 6G ® (Sumitomo Chemical Co., Ltd.), and Aizen Malachite Green ® (Hodogaya Chemical Co., Ltd.);

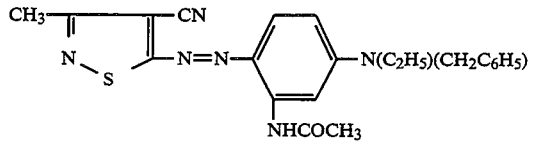
(magenta)

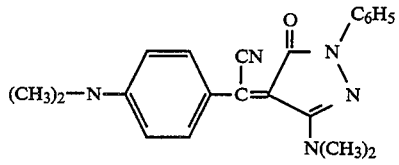
(magenta)

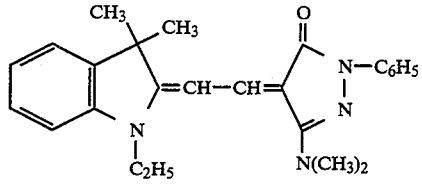
(yellow)

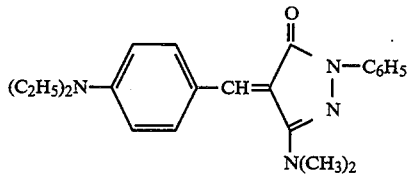
(yellow)

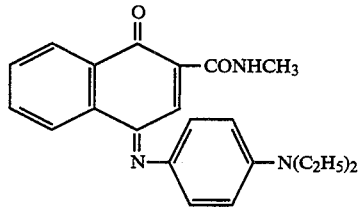
(cyan)

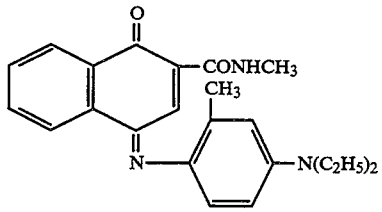
(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any slipping layer may be used in the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semicrystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element of the invention provided it is dimensionally stable! and can withstand the heat of the thermal printing heads. Such materials include polyesters such as poly(ethylene terephthalate); polyamides; polycarbonates; glassinc paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to forrn a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head FTP-040 MCSOO1, a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following examples are provided to illustrate the invention.

EXAMPLE 1

A) A contriol dye-donor element was prepared by coating on a 6 μm poly(ethylene terephthalate) support:

1) a subbing ! layer of titanium alkoxide (DuPont Tyzor TBT)® (0.11 g/m$^2$) from a n-propyl acetate and n-butyl alcohol solvent mixture, and
2) a dye layer containing the first cyan dye illustrated above (0.42 g/m$^2$ ) in a cellulose acetate propionate binder (2.5% acetyl, 45% propionyl) (0.66 g/m$^2$) coated from a toluene, methanol and cyclopentanone solvent mixture.

On the back side of the element were coated the following layers in sequence:

1) a subbing layer of titanium alkoxide (DuPont Tyzor TBT)® (0.11 g/m$^2$) from n-butyl alcohol solvent, and 2) a slipping layer containing an aminopropyldimethyl-terminated polydimethylsiloxane, PS513 ® (Petrarch Systems, Inc.)(0.0129 g/m$^2$), a copolymer of poly(-propylene oxide) and poly(methyl octyl siloxane), BYK-S732 ® (98% in Stoddard solvent) (Byk Chemie), a poly(vinyl acetal) binder (0.5382 g/m$^2$), and p-toluenesulfonic acid (0,003 g/m$^2$) coated from a 75:25 mixture of diethyl ketone and methanol.

B) Another control element was prepared similar to A) except that it had no subbing layer.

C) Another control element was prepared similar to A) except that the subbing layer was poly(N-vinyl-benzyl-N,N,N-trimethylammonium chloride-coethylene glycol dimethacrylate)(93:7 mole percent) (C-1) coated from methanol.

D) Another control element was prepared similar to C) except that the subbing layer was poly(ethylene oxide),(PEO), molecular weight 100,000, (Polyox WSR-N-10 (Union Carbide) coated from methyl alcohol at 0.11 g/m$^2$.

E) A dye-donor element according to the invention was prepared similar to C), except that the subbing layer was a 65/35 mixture of C-1 of C) and PEO of D).

A dye receiving element was prepared by coating the following layers in the order recited over a white reflective support of titanium dioxide-pigmented polyethylene-overcoated paper stock:

1) a subbing layer of poly(acrylonitrile-covinylidene chloride-co-acrylic acid) (14:79:7 wt. ratio) (0.08 g/m$^2$) coated from butanone;
2) a dye-receiving layer of a bisphenol A-polycarbonate resin, Makrolon 5705 ®, (Bayer AG),(1.6! g/m$^2$), T-1 polycarbonate (1.61 g/m$^2$) (structure below), dibutyl phthalate (0.32 g/m$^2$), diphenyl phthalate (0.32 g/m$^2$), and FC-431 ® fluorocarbon surfactant (3M Corp.) (0.011 g/m$^2$) coated from dichloromethane; and
3) an overcoat layer of T-1 polycarbonate (0.22 g/m$^2$), FC-431 ® fluorocarbon surfactant (3M Corp.) (0.032 g/m$^2$), and DC-510 ® silicone fluid (Dow Corning) (0,016 g/m$^2$) coated from dichloromethane.

T-1

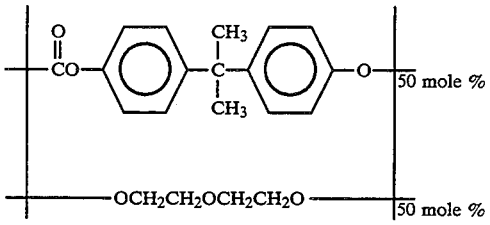

The dye side of the dye-donor elements described above, in a strip about 10×13 cm in area, was placed in contact with the dye image-receiving layer of a dye-receiver element, as described above, of the same area. The assemblage was clamped to a stepper-motor driving a 60 mm diameter rubber roller, and a TDK Thermal Head (No. L-231) (thermostatted at 24.5° C.) was pressed with a force of 36 Newtons against the dye-donor element side of the assemblage pushing it against the rubber roller.

The imaging electronics were activated causing the donor/receiver assemblage to be drawn between the printing head and the roller at 6.9 mm/sec. Coincidentally, the resistive elements in the thermal print head were pulsed for 20 microseconds/pulse at 128 microsecond intervals during the 33 millisecond/dot printing time. The voltage supplied to the print head was approximately 24.5 volts resulting in an instantaneous peak power of 1.24 watts/dot. and a maximum total energy of 9.2 mjoules/dot. The test print image consisted of an 18.5 mmwide strip of mid-density (Dmin), followed by an 18.5 mm strip of maximum density (Dmax), and an 18.5 mm strip of zero density (step 0). The force required for the pulling device to draw the donor-receiver assemblage between the print head and roller while printing this image was measured using a Himmelstein Corp. 3-08TL(16-1) Torquemeter (1.13 meter-Newton range) and a 6-201 Conditioning Module. Lower amounts of force are desirable. The results are listed in Table 1 below.

Adhesion of the slipping layer was evaluated using a tape adhesion test. A small area (approximately 1.25×4.0 cm) of Scotch Magic Transparent Tape, #810, (3M Corp) was firmly pressed by hand onto the back side of the donor. Upon manually pulling the tape, the amount of slipping layer removed was estimated and related to adhesion. Ideally none of the backing would be removed. The following categories were established for evaluation:

good—no layer removal
fair—partial layer removal
poor—substantial layer removal
very poor—total layer removal Surface electrical resistivity (SER) was determined using a Hewlett Packard 16008A Resistivity Cell in conjunction with a HP4329A High Resistance Meter. The test voltage was 100V and surface resistivities in ohms were determined after a 1 min. charging. The lower the resistivity, the better the element is for antistatic properties. The following results were obtained:

TABLE 1

| Subbing Layer | Torque Gage Friction (Newtons) Dmin | Dmax | Step 0 | Tape Adhesion | log SER (Ω) |
|---|---|---|---|---|---|
| none (control) | 8.1 | 7.4 | 7.1 | poor | 14.25 |
| Tyzor (control) | 7.4 | 6.7 | 6.1 | good | 11.64 |
| C-1 (control) | 8.1 | 6.9 | 6.4 | very poor | 9.17 |
| PEO (control) | 7.3 | 6.4 | 6.1 | fair-good | 14.28 |
| PEO/C-1 | 5.0 | 5.0 | 4.9 | good | 10.21 |

The above results show that the element with the subbing layer of the invention has better friction than all controls, better adhesion than all controls but one, and better than all controls but one for resistivity.

EXAMPLE 2

Example 1 was repeated but using the PEO/C-1 ratios as listed in Table 2. The following results were obtained:

TABLE 2

| PEO/C-1 | Tape Adhesion | log SER (Ω) |
|---|---|---|
| 0:100 | Poor | 8.55 |
| 10:90 | Poor | 8.58 |
| 25:75 | Poor-Fair | 8.53 |
| 35:65 | Fair-Good | 8.56 |
| 50:50 | Fair-Good | 9.02 |
| 65:35 | Good | 11.16 |
| 75:25 | Good | 13.67 |
| 90:10 | Good | 13.84 |

TABLE 2-continued

| PEO/C-1 | Tape Adhesion | log SER (Ω) |
|---|---|---|
| 100:0 | Good | 13.70 |

The above results show that a range of from about 30 to about 75% of C-1 in the mixture provides adequate adhesion and good resistivity.

EXAMPLE 3

This example shows the effect of using different molecular weight PEO's. Dye-donor elements were prepared as in Example 1 except that three different molecular weight PEO's were used as follows:

18,500 poly(ethylene oxide) (Polysciences, Inc.)

100,000 poly(ethylene oxide) (Scientific Polymer Products)

900,000 poly(ethylene oxide) (Scientific Polymer Products).

These poly(ethylene oxides) were coated in a 65/35 mixture with C-1,(0.11 g/m$^2$) on a 6 μm poly(ethylene terephthalate) support. The following results were obtained:

TABLE 3

| PEO (M.W.) | Tape Adhesion |
|---|---|
| 18,500 | very poor |
| 100,000 | good |
| 900,000 | good |

The above results show that the molecular weight of the poly(ethylene oxide) should be at least 100,000 in order to obtain good adhesion.

EXAMPLE 4

Dye-donor elements were prepared as in Example 1 except using the different subbing materials and laydowns as listed in Table 4. The following results were obtained:

TABLE 4

| Subbing Layer | Laydown (g/m$^2$) | Tape Adhesion | log SER (Ω) |
|---|---|---|---|
| none (control) | — | poor | 14.25 |
| Tyzor (control) | 0.11 | good | 11.64 |
| C-1 (control) | 0.11 | very poor | 9.17 |
| PVP* (comparison) | 0.11 | very poor | 14.01 |
| PVP/C-1 65:35 (comparison) | 0.11 | poor | 14.52 |
| PVP/C-1 75:25 (comparison) | 0.11 | poor | 14.10 |
| PEO (control) | 0.11 | fair–good | 14.28 |
| PEO/C-1 65:35 | 0.11 | good | 10.21 |
| PEO/C-1 65:35 | 0.22 | fair | 9.36 |
| KL3**/C-1 65:35 | 0.11 | fair–good | 12.05 |
| P-1***/C-1 65:35 | 0.11 | good | 10.10 |

*PVP = poly(vinylpyrrolidone)
**KL3 = a polyether/polycarbonate copolymer from Miles Laboratories.
***P-1 = a copolymer of n-butyl acrylate, poly(propylene glycol) monomethacrylate, and methyl 2-acrylamido-2-methoxyacetate (50:25:25 wt. ratio).

The above results again show the good adhesion and resistivity of the invention polymer mixtures at different laydown levels as compared to various controls and comparison mixtures.

EXAMPLE 5

Dye-donor elements were prepared as in Example 1 except for using additives of control antistatic materials or polymeric materials of the invention in the subbing layer, along with PEO, as listed in Table 5. The following results were obtained:

TABLE 5

| Additive | PEO/Additive Ratio | Tape Adhesion | log SER (Ω) |
|---|---|---|---|
| C-1 | 65:35 | good | 11.16 |
| $N(CH_3)_4Cl$ (control) | 65:35 | very poor | 13.26 |
| diallyl dimethyl ammonium chloride polymer (control) | 65:35 | very poor | 14.02 |
| Gafquat ® 734* (control) | 65:35 | good | 14.25 |
| P-2** | 50:50 | good | 10.07 |
| P-3*** | 50:50 | good | 10.46 |

*Gafquat ® 734 = quaternized copolymer of vinylpyrrolidone and dimethylaminoethyl methacrylate from GAF Corp.
**poly[2-(N,N,N-trimethylammonium)ethyl methacrylate methosulfate]
***poly[2-(N,N-diethylamino)ethyl methacrylate/ethylene glycol dimethacrylate hydrochloride]

The above results show the effectiveness of the polymer mixtures of the invention as compared to various control mixtures.

EXAMPLE 6

This example shows that similar results are obtained using different slipping layers. Example 1 was repeated using a PEO/C-1 subbing layer but with varying the slipping layer as shown in Table 6 below. The following results were obtained:

TABLE 6

| Slipping Layer Binder | Slipping Layer Lubricants | Tape Adhesion | log SER (Ω) |
|---|---|---|---|
| Poly(vinyl acetal) | PS-513 + BYK-S732 | good | 11.16 |
| Cellulose Acetate Propionate | Montan Wax | good | 9.29 |
| Poly(vinyl butyral)* | PS-513 + BYK-S732 | good | 10.09 |

*Butvar B76 ® (a poly(vinyl butyral) available from Monsanto Co.)

The above results show that good adhesion and resistivity are obtained using the subbing layer of the invention with various slipping layers.

EXAMPLE 7

This example shows the impact of solution stability on performance. The control subbing solution is titanium alkoxide (DuPont Tyzor TBT) ® (6.4% solids in propyl acetate/n-butanol 85:15). The invention subbing solution is PEO/C-1 65:35 (5.75% solids in methanol). Both subbing solutions were aged in an open gravure pan before gravure coating with a wet laydown of 2.37 cc/m$^2$. Example 1 was then repeated using these subbing solutions with the following results:

TABLE 7

| Subbing Material | Solution Age (Minutes) | Tape Adhesion | log SER (Ω) |
|---|---|---|---|
| Tyzor ® | 3 | Fair–Good | 11.36 |
| Tyzor ® | 10 | Fair–Good | 11.29 |
| Tyzor ® | 20 | Fair | 11.36 |
| Tyzor ® | 30 | Fair | 11.34 |
| Tyzor ®* | 40 | Poor | 11.49 |
| PEO/C-1 | 3 | Good | 9.76 |

TABLE 7-continued

| Subbing Material | Solution Age (Minutes) | Tape Adhesion | log SER (Ω) |
|---|---|---|---|
| PEO/C-1 | 10 | Good | 9.57 |
| PEO/C-1 | 20 | Good | 9.64 |
| PEO/C-1 | 35 | Good | 9.95 |
| PEO/C-1 | 40 | Good | 9.42 |

*Tyzor ® precipitated at 37 minutes

The above results show that the invention subbing layers have better adhesion and resistivity than the prior art materials and do not age in the coating solution.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having on one side thereof a dye layer and on the other side thereof, in order, a subbing layer and a slipping layer, and wherein said subbing layer has antistatic properties and comprises a mixture of 1) a polymer having a molecular weight of at least about 100,000 and containing at least 25 wt. % of a repeating unit containing an alkylene oxide segment, and 2) a copolymer having the formula:

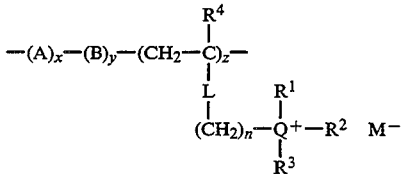

wherein:

A represents units of an addition polymerizable monomer containing at least two ethylenically unsaturated groups;

B represents units of a copolymerizable $\alpha,\beta$-ethylenically unsaturated monomer;

L is a carboxylic group or an aromatic ring;

Q is N or P;

$R^1$, $R^2$ and $R^3$ each independently represents an alkyl or cycloalkyl group having from about 1 to about 20 carbon atoms, or an a ryl or aralkyl group having from about 6 to about 10 carbon atoms;

$R^4$ is H or $CH_3$;

M is an anion;

n is an integer of from 1 to 6;

x is from about 0 to about 20 mole %;

y is from about 0 to about 90 mole %; and z is from about 10 to about 100 mole %;

said copolyrner 2) being present in said mixture in an amount from about 30 to about 75 wt. %.

2. The element of claim 1 wherein said 1) polymer is poly(ethylene oxide); poly(butyl acrylate-co-propylene glycol monomethacrylate-co-methyl 2-acrylarnido-2-methoxyacetate); poly(propylene glycol); or a copolymer of n-butyl acrylate, poly(propylene glycol)-monomethacryate, and methyl 2-acrylarnido-2-methoxyacetate.

3. The element of claim 1 wherein said 2) copolymer is poly(N-vinylbenzyl-N,N,N-trirnethylammonium chloride-co-ethylene glycol dimethacrylate) (93:7 mole percent); poly[2-(N,N,N-trirnethylammoniurn)ethyl methacrylate rnethosulfate]; poly[2-(N,N,N-trimethylammonium)ethyl acrylate methosulfate]; or poly[2-(N,N-diethylarnino)ethyl methacrylate hydrogen chloride-co-ethylene glycol dimethacrylate](93:7 mole percent).

4. The element of claim 3 wherein said mixture comprises poly(ethylene oxide) and poly(N-vinylbenzyl-N,N,N-trirnethylammonium chloride-coethylene glycol dimethacrylate) (93:7 mole percent).

5. A process of forming a dye transfer image comprising:

(a) imagewise-heating a dye-donor element comprising a support having on one side thereof a dye layer and on the other side thereof, in order, a subbing layer and a slipping layer, and (b) transferring a dye image to a dye receiving element to form said dye transfer image, wherein said subbing layer has antistatic properties and comprises a mixture of 1) a polymer having a molecular weight of at least about 100,000 and containing at least 25 wt. % of a repeating unit containing an alkylene oxide segment, and 2) a copolymer having the formula:

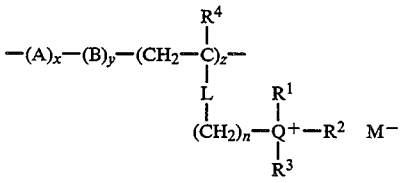

wherein:

A represents units of an addition polymerizable monomer containing at least two ethylenically unsaturated groups;

B represents units of a copolyrnerizable $\alpha,\beta$-ethylenically unsaturated monomer;

L is a carboxylic group or an aromatic ring;

Q is N or P;

$R^1$, $R^2$ and $R^3$ each independently represents an alkyl or cycloalkylgroup having from about 1 to about 20 carbon atoms, or an aryl or aralkyl group having from about 6 to about 10 carbon atoms;

$R^4$ is H or $CH_3$;

M is an anion;

n is an integer of from 1 to 6;

x is from about 0 to about 20 mole %;

y is from about 0 to about 90 mole %; and z is from about 10 to about 100 mole %;

said copolymer 2) being present in said mixture in an amount from about 30 to about 75 wt. %.

6. The process of claim 5 wherein said 1) polymer is poly(ethylene oxide); poly(butyl acrylate-co-propylene glycol monomethacrylate-co-methyl 2- acrylamido-2-methoxyacetate); poly(propylene glycol); or a copolymer of n-butyl acrylate, poly(propylene glycol) monomethacrylate, and methyl 2-acrylamido-2-methoxyacetate.

7. The process of claim 5 wherein said 2) copolymer is poly (N-vinylbenzyl-N,N,N-trimethylammonium chloride-co-ethylene glycol dimethacrylate) (93:7 mole percent); poly[2- (N,N,N-trimethylammonium)ethyl methacrylate methosulfate]; poly[2-(N,N,N-trimethylammonium)ethyl acrylate methosulfate]; or poly[2-(N,N-diethylamino)ethyl methacrylate hydrogen chloride-co-ethylene glycol dimethacrylate](93: 7 mole percent).

8. The process of claim 5 wherein said mixture comprises poly(ethylene oxide) and poly(N-vinylbenzyl-N,N,N-trimethylammonium chloride-coethylene glycol dimethacrylate) (93:7 mole percent).

9. A thermal dye transfer assemblage comprising (a) a dye-donor element comprising a support having on one side thereof a dye layer and on the other side thereof, in order, a subbing layer and a slipping layer, and (b) a dye receiving element comprising a support having thereon a dye image-receiving layer, said dye-receiving element being in a superposed relationship with said dye-donor element so that said dye layer is in contact with said dye image-receiving layer, wherein said subbing layer has antistatic properties and comprises a mixture of 1) a polymer having a molecular weight of at least about 100,000 and containing at least 25 wt. % of a repeating unit containing an alkylene oxide segment, and 2) a copolymer having the formula:

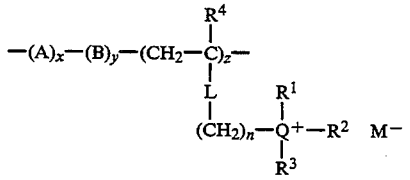

wherein:

A represents units of an addition polymerizable monomer containing at least two ethylenically unsaturated groups;

B represents units of a copolymerizable $\alpha,\beta$-ethylenically unsaturated monomer;

L is a carboxylic group or an aromatic ring;

Q is N or P;

$R^1$, $R^2$ and $R^3$ each independently represents an alkyl or cycloalkyl group having from about 1 to about 20 carbon atoms, or an a ryl or aralkyl group having from about 6 to about 10 carbon atoms;

$R^4$ is H or $CH_3$;

M is an anion;

n is an integer of from 1 to 6;

x is from about 0 to about 20 mole %;

y is from about 0 to about 90 mole %; and z is from about 10 to about 100 mole %;

said copolymer 2) being present in said mixture in an amount from about 30 to about 75 wt. %.

10. The assemblage of claim 9 wherein said 1) polymer is poly(ethylene oxide); poly(butyl acrylate-co-propylene glycol monomethacrylate-co-methyl 2-acrylamido-2-methoxyacetate); poly(propylene glycol); or a copolymer of n-butyl acrylate, poly(propylene glycol) monomethacrylate, and methyl 2-acrylamido-2-methoxyacetate.

11. The assemblage of claim 9 wherein said 2) copolymer is poly(N-vinylbenzyl-N,N,N-trimethylammonium chloride-co-ethylene glycol dimethacrylate) (93:7 mole percent); poly[2-(N,N,N-trimethylammonium)ethyl methacrylate methosulfate]; poly[2-(N,N,N-trimethylarnmonium) ethyl acrylate methosulfate]; or poly[2-(N,N-diethylamino)ethyl methacrylate hydrogen chloride-co-ethylene glycol dimethacrylate](93:7 mole percent).

12. The assemblage of claim 9 wherein said mixture comprises poly(ethylene oxide) and poly(N-vinylbenzyl-N,N,N-trimethylammonium chloride-coethylene glycol dimethacrylate) (93:7 mole percent).

* * * * *

UNITED STATES PATENT AND TRADEMARK OFFICE

CERTIFICATE OF CORRECTION

PATENT NO. : 5,336,659

DATED : August 9, 1994

INVENTOR(S) : Charles L. Bauer and Noel R. Vanier

It is certified that error appears in the above-indentified patent and that said Letters Patent is hereby corrected as shown below:

In the Abstract, line 23, "$Ch_3$" should read --$CH_3$--.

Column 11, line 55, "copolyrner" should read --copolymer--; line 59, "2-acrylarnido-2-" should read -- 2-acrylamido-2- --; line 62, "monomethacryate" should read --monomethacrylate-- and "2-acrylarnido-2-methox-" should read -- 2-acrylamido-2-methox- --; line 65, "trirnethylammonium" should read -- trimethylammonium --; line 67, "trirnethylammoniurn)ethyl" should read -- trimethylammonium)ethyl --; line 68, "rnethosulfate]" should read -- methosulfate] --.

Column 12, line 2, "(N,N-diethylarnino)ethyl" should read -- (N,N-diethylamino)ethyl --; line 7, "N,N,N-trirnethylammonium" should read -- N,N,N-trimethyl-ammonium --; line 37, "copolyrnerizable" should read --copolymerizable--; and line 42, "cycloalkylgroup" should read --cycloalkyl group --.

UNITED STATES PATENT AND TRADEMARK OFFICE

CERTIFICATE OF CORRECTION

PATENT NO. : 5,336,659

DATED : August 9, 1994

INVENTOR(S) : Charles L. Bauer and Noel R. Vanier

It is certified that error appears in the above-indentified patent and that said Letters Patent is hereby corrected as shown below:

Column 14, line 7, "a ryl" should read --aryl--; line 29, "thylarnmonium)" should read --thylammonium)--; and line 35, "chloride-coethylene" should read -- chloride-co-ethylene --.

Signed and Sealed this

Seventeenth Day of January, 1995

*Attest:*

Bruce Lehman

BRUCE LEHMAN

*Attesting Officer*

*Commissioner of Patents and Trademarks*